US007100816B2

(12) United States Patent
Offenbacher

(10) Patent No.: US 7,100,816 B2
(45) Date of Patent: Sep. 5, 2006

(54) SECURE MAIL RECEPTACLE

(76) Inventor: James Douglas Offenbacher, 6677 Foothill Ranch Rd., Santa Rosa, CA (US) 95404

( * ) Notice: Subject to any disclaimer, the term of this patent is extended or adjusted under 35 U.S.C. 154(b) by 238 days.

(21) Appl. No.: 10/850,506

(22) Filed: May 20, 2004

(65) Prior Publication Data

US 2004/0238615 A1 Dec. 2, 2004

Related U.S. Application Data

(60) Provisional application No. 60/473,556, filed on May 27, 2003, provisional application No. 60/473,491, filed on May 27, 2003.

(51) Int. Cl.
*B65G 11/04* (2006.01)

(52) U.S. Cl. ..... 232/45; 232/17

(58) Field of Classification Search ..... 232/47, 232/45, 17, 43.1, 43.4; 193/8
See application file for complete search history.

(56) References Cited

U.S. PATENT DOCUMENTS

| | | | | |
|---|---|---|---|---|
| 3,502,261 | A | 3/1970 | AntonioSolis | |
| 3,802,619 | A | 4/1974 | Vandeveer | |
| 4,333,603 | A | 6/1982 | Carlson | |
| 4,361,271 | A | 11/1982 | Hester et al. | |
| 4,724,999 | A | 2/1988 | Fitzgerald et al. | |
| 4,726,512 | A | 2/1988 | White | |
| 4,993,626 | A | 2/1991 | Berry | |
| 5,056,711 | A | 10/1991 | Bush | |
| 5,096,115 | A | 3/1992 | Hassan | |
| 5,526,979 | A * | 6/1996 | Mann | 232/33 |
| 5,915,618 | A | 6/1999 | Gaudet | |
| 6,234,388 | B1 * | 5/2001 | Taylor | 232/47 |
| D483,543 | S * | 12/2003 | Stoll et al. | D99/29 |
| 6,722,561 | B1 * | 4/2004 | Thomas et al. | 232/39 |
| 6,976,620 | B1 * | 12/2005 | Swider | 232/45 |

OTHER PUBLICATIONS

Four page description of locking mailbox entitled Mail Chests, item 4350, appearing on Salsbury Industries web site, first published on a date unknown, but prior to Mar. 2002.
Four page description of locking Mailbox entitled Mail Package Drops, item 4375, appearing on Salisbury Industries web site, first published on a date unknown, but prior to Mar. 2002.

* cited by examiner

*Primary Examiner*—William L. Miller
(74) *Attorney, Agent, or Firm*—Lawrence Edelman

(57) ABSTRACT

A device is created for placement within a rural style mail box to provide a secure repository for items of mail delivered. A forward positioned, secure chamber for the storage of delivered items is defined by a first insert having a top surface, and two supporting side surfaces. A separate assembly placed rear of the first insert includes an opposing slide assembly defined by a smooth surface with an inclination against the rear of the mail box and sloped downwardly toward the secure storage area. Coming into contact with the slide assembly, mail is thus redirected to the secure area. In an alternative embodiment, a unitary mailbox is described which includes an inclined compression delivery channel for delivery of mail to a secure chamber beneath, the compression channel at the same time presenting an obstacle to unauthorized access.

5 Claims, 11 Drawing Sheets

SECURE MAIL RECEPTACLE

CROSS-REFERENCE TO RELATED APPLICATIONS

This application claims priority to Provisional Application 60/473,556 filed May 27, 2003, entitled Secure Mail Receptacle, James Douglas Offenbacher, inventor, and Provisional Application 60/473,491 filed May 27, 2003, entitled Mail Theft Deterrent System, James Douglas Offenbacher, inventor. Each of the aforementioned related patent applications is herein incorporated by reference.

BACKGROUND OF THE INVENTION

The present invention relates generally to theft-resistant mail boxes, and more particularly to rural mailboxes which are secure in that mail, once inserted cannot be removed except by an authorized individual.

Today, identity theft is becoming a significant problem, made worse by the ease by which mail can easily be stolen from current rural mailboxes. Such provide no security in that they can be opened by anyone at anytime, and the contents simply removed. As a result, there is a need for providing an inexpensive means for deterring the pilfering of mail from the standard rural mailbox.

SUMMARY OF THE INVENTION

By way of this invention, two approaches are described. One provides for the insertion of components into existing mailboxes to define a secure chamber for storage of delivered mail. The other provides a new mailbox design incorporating a compression delivery channel to prevent unauthorized access to the mail once inserted into the mailbox.

More particularly, in the first embodiment of this invention a retrofit for existing mailboxes is provided in the form of an article of construction which can be secured to the interior of the mailbox walls, either by an ultimate end user or an original equipment manufacturer. The insert in its most basic form comprises a forward frame assembly, including a vertical front wall incorporating an access door which is hingedly mounted to the forward frame assembly, a horizontally disposed top wall extending from the top of the frame rearward a predetermined distance to define a cover plate over which mail can be passed, such as by sliding, and a separate sloped catch plate assembly spaced a distance from the end of the cover plate to define a second passageway for inserted mail. The catch plate is so placed as to redirect the inserted mail downwardly and in reverse direction to a secure storage chamber bounded by the vertically disposed access door and horizontally disposed cover plate. Access to the storage chamber for retrieval of deposited items is effected by an authorized individual having means, such as a key, to unlock the locking mechanism associated with the access door. The combination of cover plate and catch plate can be provided in various configurations, either as part of a single, insertable assembly or as two separate, insertable component sub assemblies, which can be either removably or fixedly secured.

In another embodiment, a singular mailbox assembly is provided which includes a compression delivery channel, defined in part by a sloped guide plate extending upward and rearward from the base of a mailbox mail slot opening. Delivery to a secure storage chamber is effected by insertion of to-be-delivered mail into and through the inclined compression channel, the thus delivered mail thereafter dropping unimpeded into the secure storage chamber.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
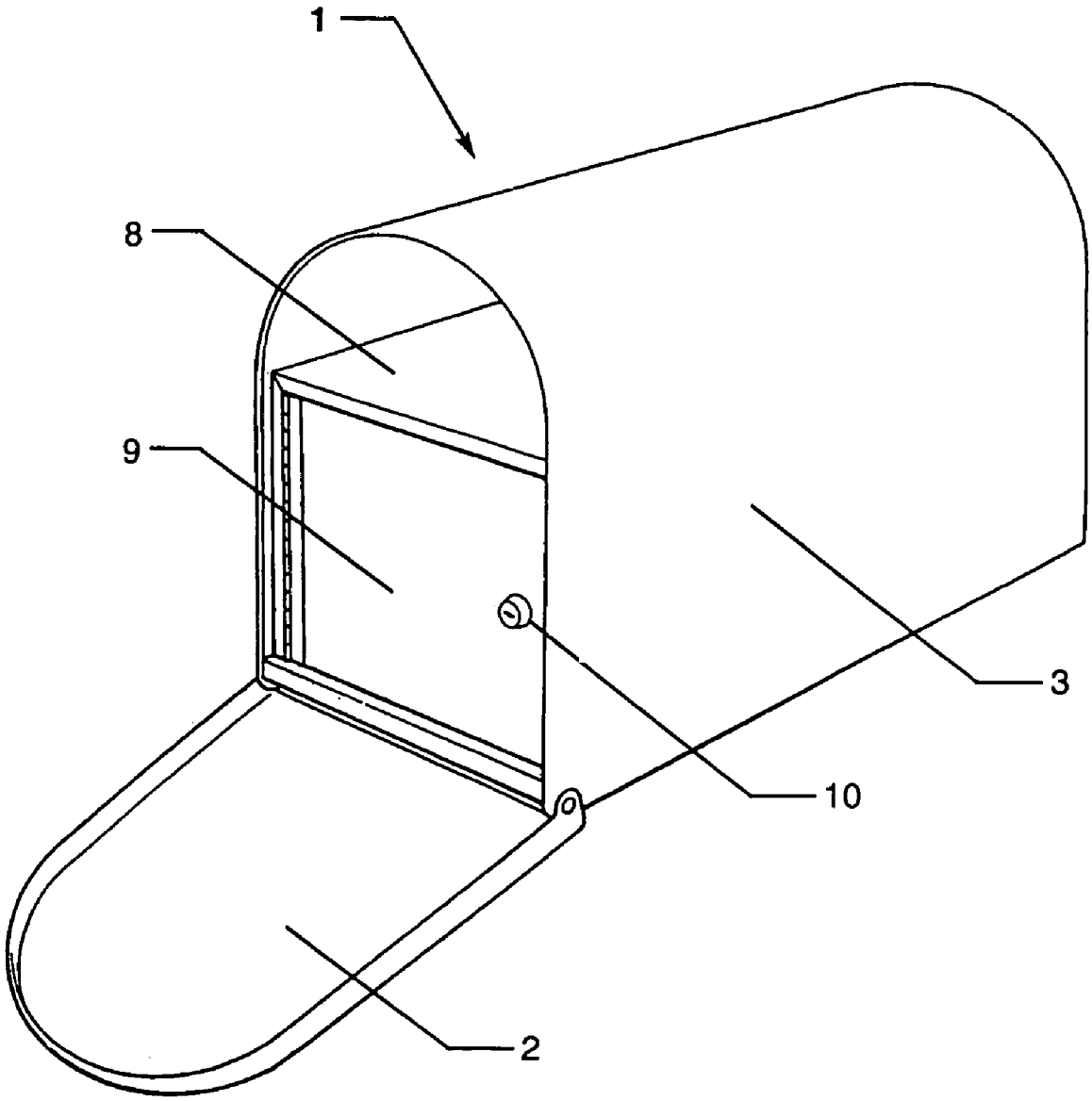
FIG. 1 is a three dimensional illustration of a secure mailbox showing the front of an insert of this invention.

With reference now to FIG. 1, a typical rural mailbox 1 is illustrated, having an openable front cover 2 for a mailbox housing 3, said housing having a top, sides, front and back walls to generally define a box.

Figure 2:
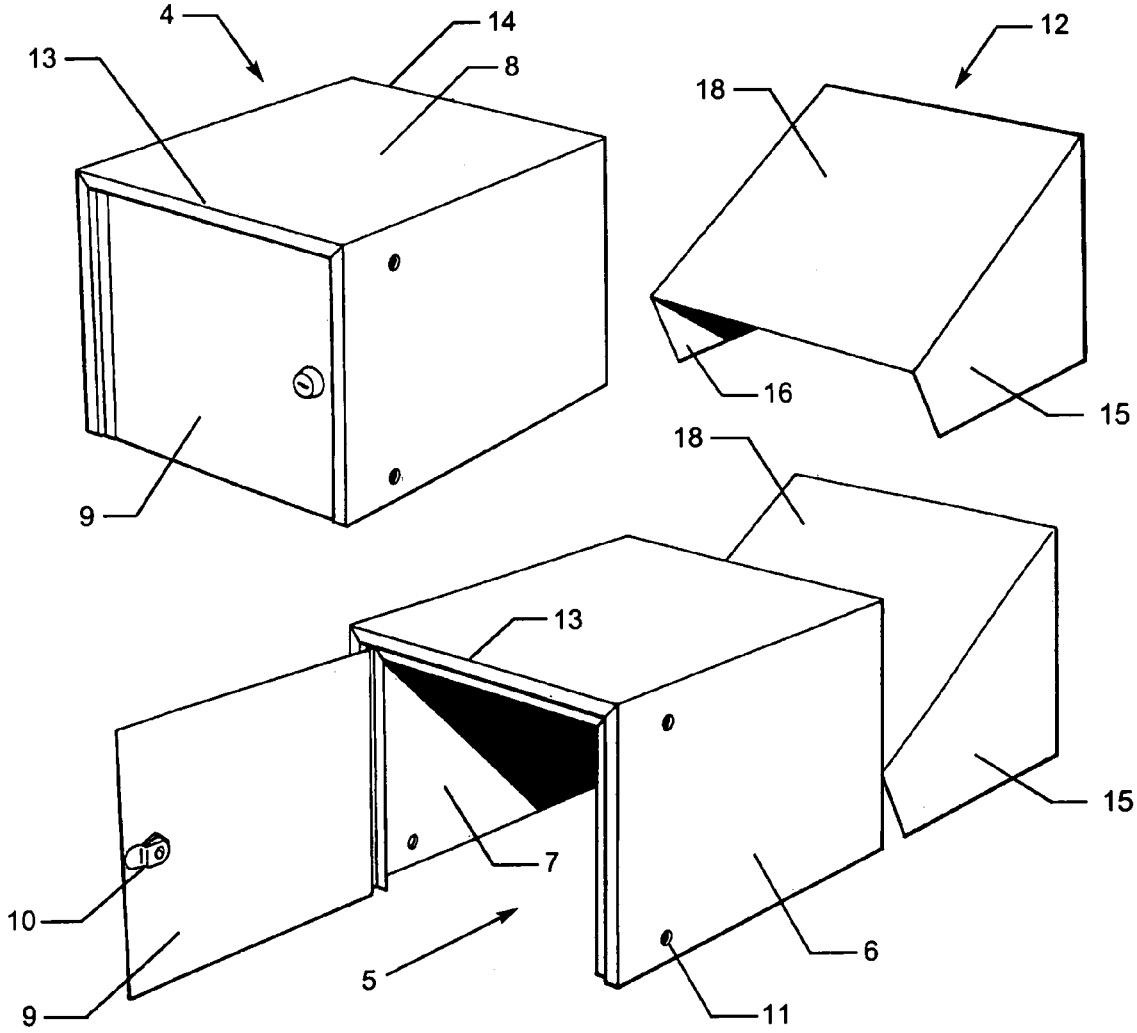
FIG. 2 is a three dimensional view of a two part insert.

FIG. 2 shows an insert of the invention comprising two assemblies. The assemblies are sized to define a pathway for letters, and other mailed objects, as well as provide a secure compartment, one which cannot be reached by insertion of a hand into the mailbox. First, forward assembly 4 defines a secure chamber 5, the chamber bounded by side walls 6 and 7, top wall or cover plate 8 and a front face incorporating a hinged door 9, the rear of the forward assembly remaining open. Cover plate 8, which extends from the front face of the box rearward a predetermined distance into the box, and spans the box internally between the side walls, includes a leading edge or lip 13, and a trailing edge or lip 14. The plate defines a transport surface over which mail can be passed, such as by sliding. Door 9 is provided with a locking mechanism 10, e.g. one which can be key activated. Access to the secure chamber is effected by simply disengaging the locking mechanism, and mechanically opening the door. The two supporting side walls 6 and 7 are additionally provided with means for attaching the storage chamber assembly to the interior of the mail box walls. As illustrated in FIG. 2, the securing means can simply comprise a plurality of drilled holes 11 in the side walls in registry with similarly drilled holes in the walls of the mailbox housing (not shown), through which a bolt can be inserted and internally secured, such as by a wing nut.

Second, rear assembly 12 is positioned behind of the first assembly and can, but need not necessarily, be secured to the side of the mail box in a fashion similar to the forward assembly. This rearward assembly, as illustrated, consists of opposing side walls 15 and 16, spaced by catch plate 18, which defines a reverse sloped capture surface. When inserted into a standard mailbox, a letter or other object will be passed through the passageway defined by the top wall, side walls, and the top surface of cover plate 8, its forward progress stopped by coming into contact with the surface of catch plate 18, the capture surface redirecting the inserted object downward and forward into the secure chamber.

Figure 3:
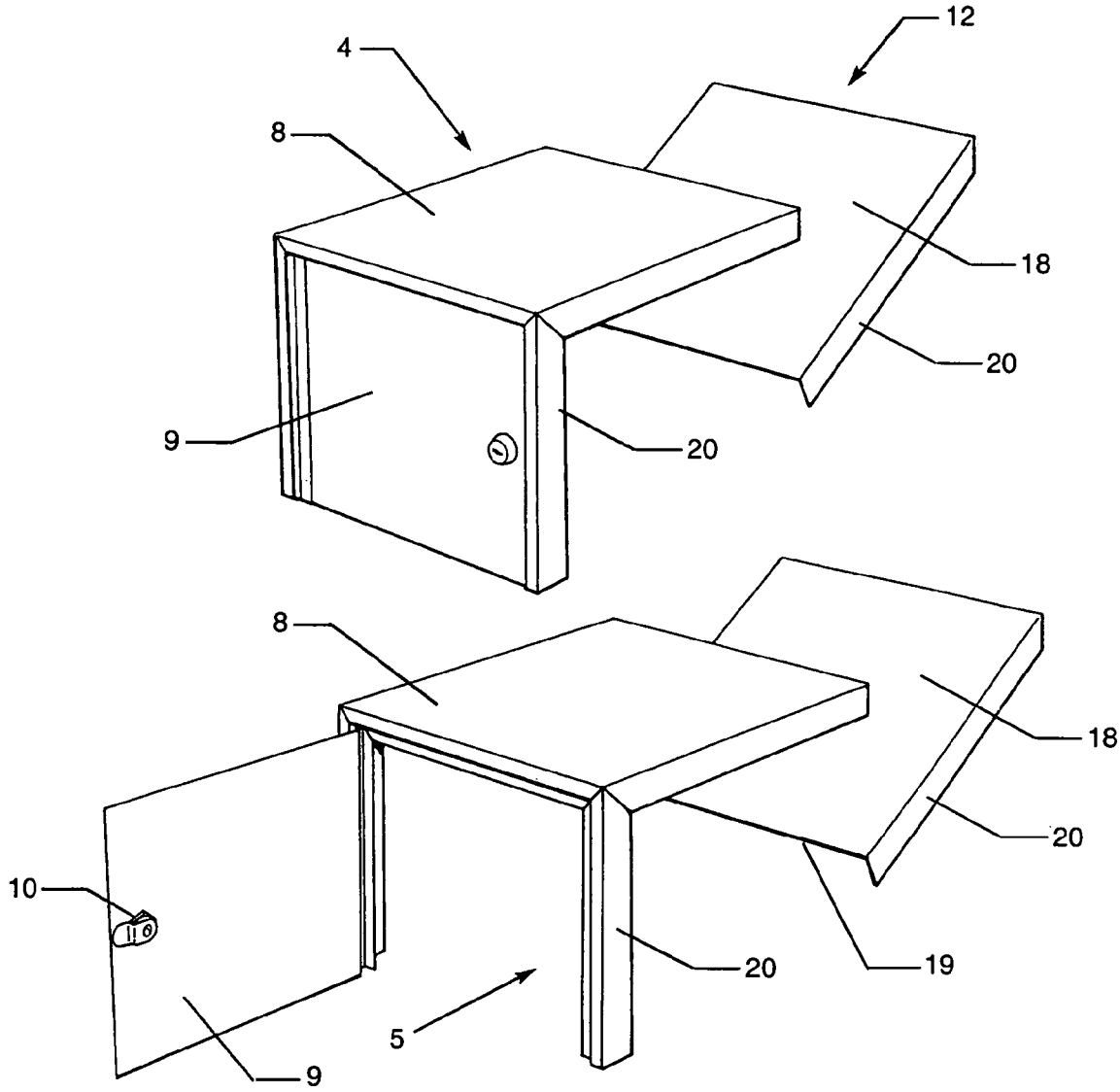
FIG. 3 is a three dimensional view of an alternative two part insert.

In the embodiment of FIG. 3, rear assembly 12 is fabricated from a single sheet of material with flanges 20 formed at right angles to catch plate 18. Side walls 6 and 7 of the forward assembly 4 have also been eliminated to reduce costs of construction, replaced by similar flanges 20 extending downwardly from cover plate 8. Given that the assembly is not capable of free standing, as is the case of the assemblies of FIG. 2, both must be secured to the sides of the mailbox. This can be done by gluing, spot welding, or by using similar fastening means used in connection with the embodiment of FIG. 2, providing drill holes along flanges 20 with matching holes in the walls of the mailbox.

With the mailbox insert of FIG. 4, the cover plate 8 of the forward assembly has been modified such that a portion of the cover plate is cut back and bent downwardly from top of side wall 7 at an angle sufficient to provide a secondary sloped surface 22 for directing mail pieces directly into the chamber downward and to the right, below the cover plate. The opening afforded in this embodiment, running longitudinally along the side wall of forward assembly 4, is kept narrow enough to prevent unauthorized persons from inserting a hand there-through to reach the contents of the chamber, yet large enough to allow for the passage of mail items such as magazines. As can be seen from the figure, the provision of this second passageway allows longer items to be inserted into the mailbox and be redirected into the locked chamber.

Figure 4:
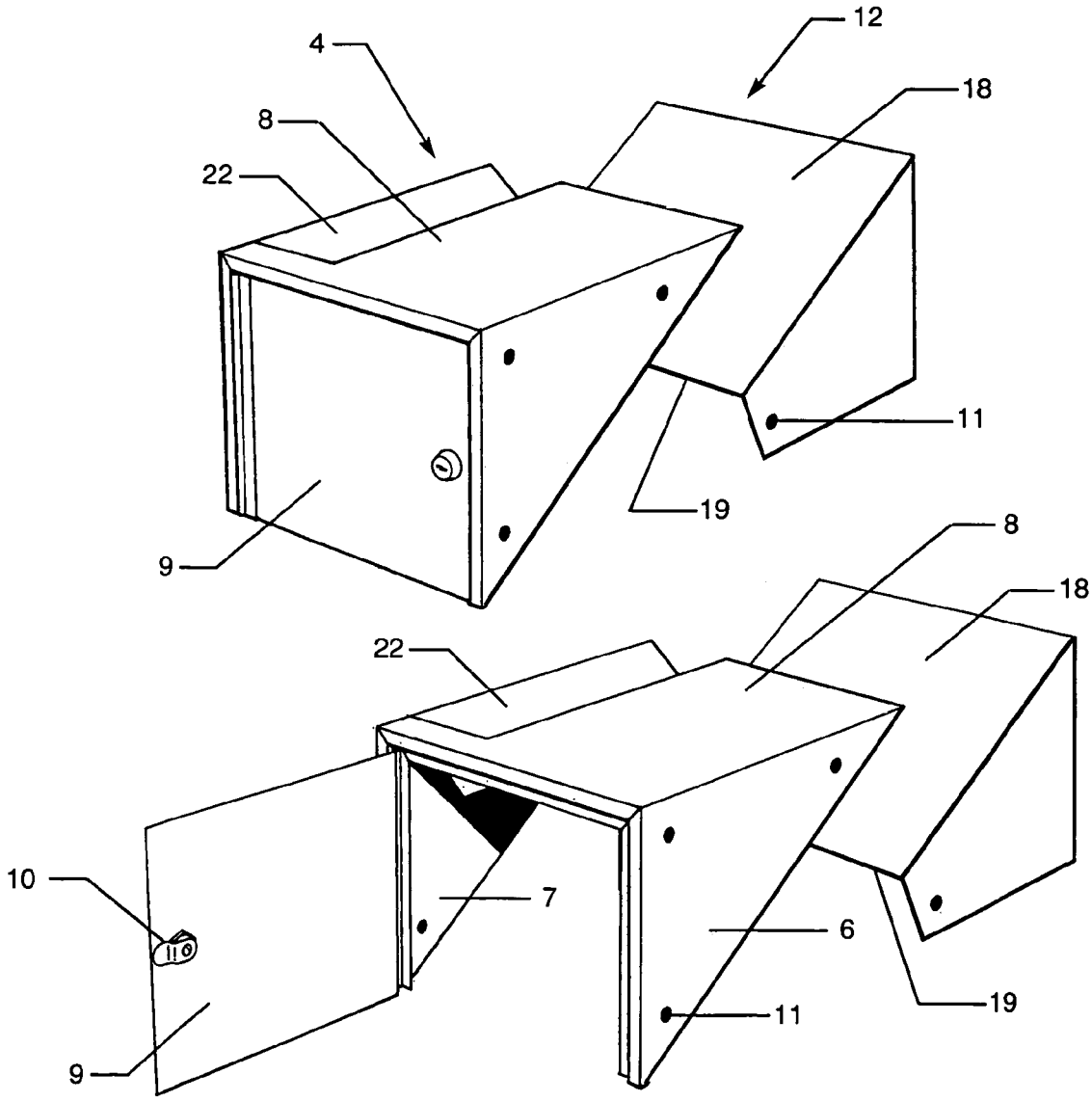
FIG. 4 is a three dimensional view of an alternative embodiment of the two part insert of FIG. 2.
Figure 5:
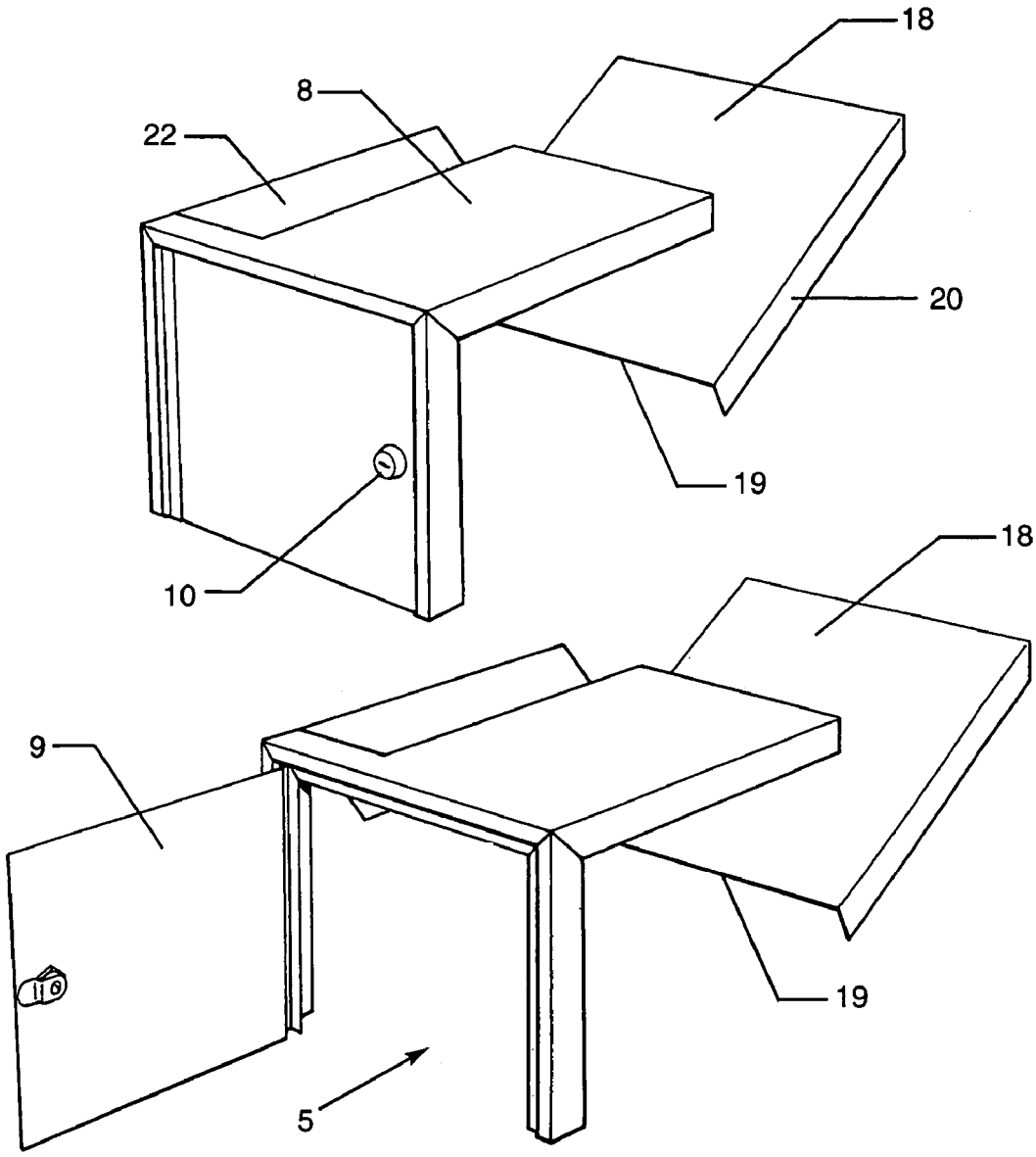
FIG. 5 is a three dimensional view of an alternative embodiment of the two part insert of FIG. 3.

Illustrated in FIG. 5 is another variation in which the forward assembly of FIG. 3 has been modified in the manner of the forward assembly of FIG. 4 to provide a secondary sloped surface 22 for directing mail into secure chamber 5.

Figure 6:
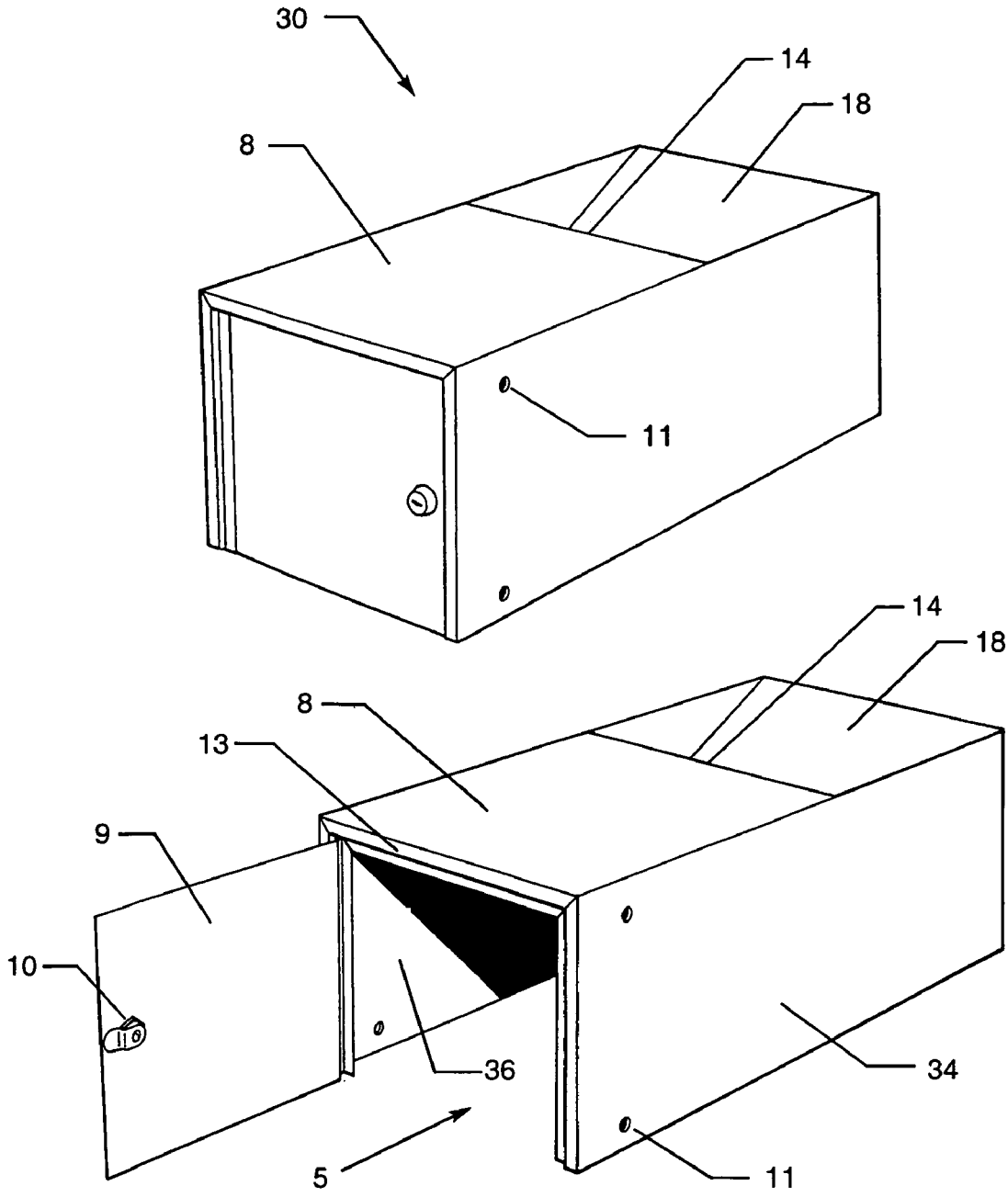
FIG. 6 is a three dimensional view of an insert combining the cover plate and catch plate features in a singular assembly.

Illustrated in FIG. 6 is yet another embodiment of the invention, comprising a free standing, unitary, rectangular assembly 30 having a front, lockable access door 9, the door hinge-mounted thereto. Vertically disposed, extended side walls 34 and 36 span the length of the assembly and the interior of the mail box housing, with cover plate 8 extending a predetermined distance rearward from leading edge 13, defining there-beneath a secure chamber 5 reachable only by unlocking and opening access door 9. A catch plate 18 defining a capture surface is provided with a reverse slope at the rear of inset 30 to define an inclined path to redirect the movement of mail which has been inserted into the mailbox beyond trailing edge 14 of cover plate 8. The assembly can be fastened through tap holes 11 to the sides of the existing mail box in a manner similar to the other, earlier described embodiments, to secure it in place.

In use, mail inserted into the box such as by sliding is inserted to the point its trailing edge extends beyond edge 14 to be engaged by the capture surface of catch plate 18. As the trailing edge of the inserted object passes beyond lip 14, it will drop down, and now in contact with reverse sloped capture surface, slide forward towards the front of the mailbox, coming to rest inside secure chamber 5. In this location it is not possible for a person to reach in and retrieve mail within the chamber.

Figure 7:
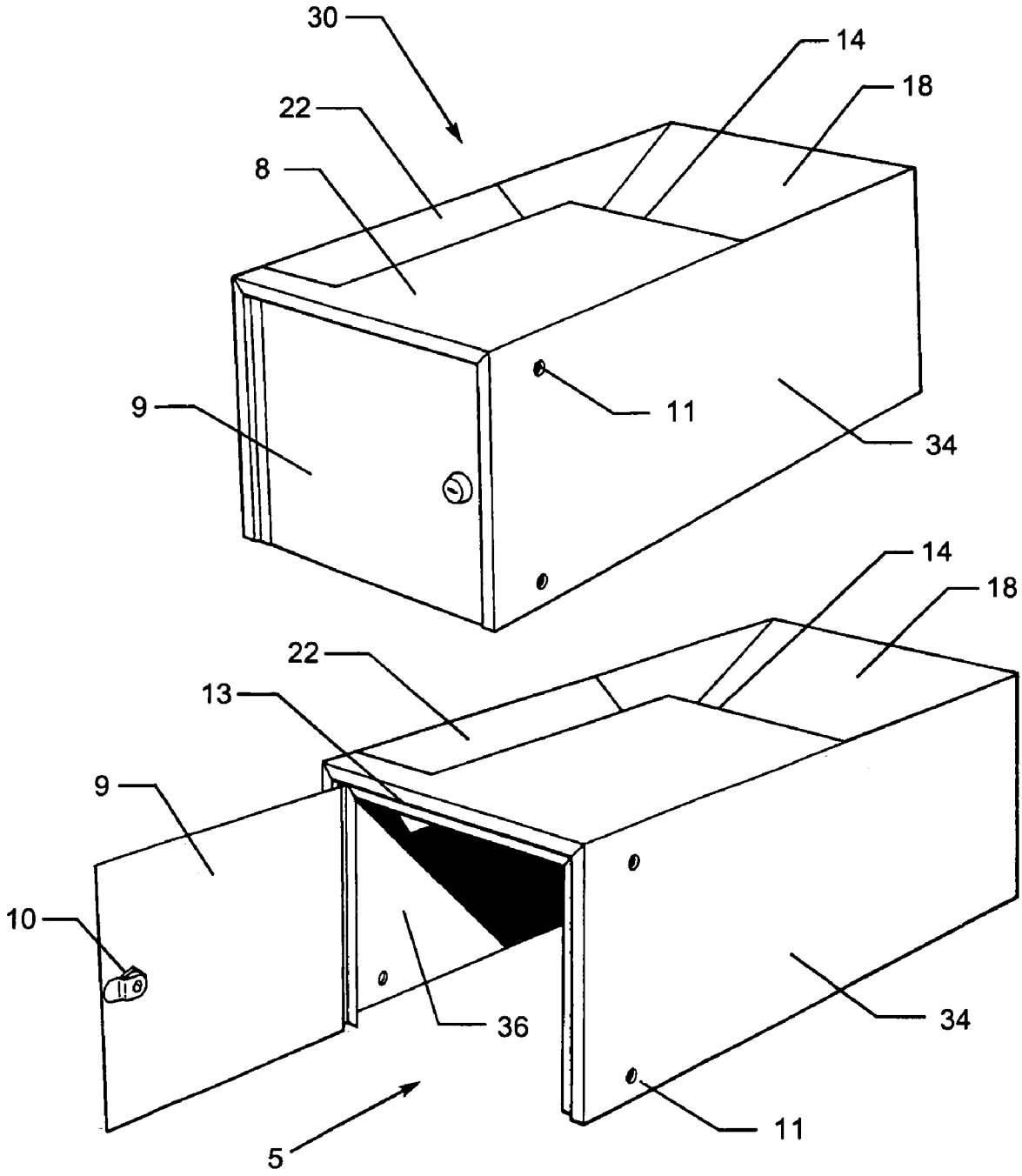
FIG. 7 is a three dimensional view of an alternative embodiment of the singular assembly of FIG. 6.

In an embodiment of this unitary design illustrated in FIG. 7, a secondary sloped surface 22 is provided which depends from one of the extended side walls to define a longitudinal slot to re-direct inserted mail downwardly and to the side, so that it comes to rest in chamber 5 beneath cover plate 8, inaccessible except by opening of the front door. This embodiment operates much in the fashion of the embodiments of FIGS. 4 and 5 to effectively receive and direct longer pieces of mail into the secure chamber.

Generally, with the embodiments of FIGS. 1–7, the length of the opening defined between the trailing edge 14 of the cover plate and the back top edge of the capture surface of the catch plate should be at least as large as, if not larger than the length of the longest piece of mail to be inserted into the box. In this way, mail slid past edge 14 of the cover plate can easily pass beyond that edge where it encounters the surface of catch plate 18, and drops downwardly below edge 14 and forward into chamber 5.

In order to prevent accumulated mail from blocking the forward transport of inserted mail into the secure chamber, the sloped surface of the catch plate is configured so that its forward edge 19 sits a set distance from the floor of the mailbox. Typically, for a standard rural mailbox, the end of the catch plate will be spaced about 1 to 1½ inches, or more, above the mailbox floor. The greater the distance, the larger the volume provided for receipt of mail below forward edge 19, thus providing a larger reservoir for the accumulation of mail. In this way, previously deposited mail will not act as a dam to interfere with the delivery of later delivered mail, which mail would otherwise prevent later-inserted mail from sliding forward into the secure chamber, and thereby become accessible to retrieval by an unauthorized individual. The slope of the capture surface should be sufficient to assure inserted mail will be transported downward and forward to the secure compartment, but not be too shallow such that received mail fails to slide forward.

In one embodiment, side walls 6 and 7 can be cut away along a line within a plane spaced from and substantially parallel to the sloped capture surface of catch plate 18. Alternatively, the side walls can be cut back along a line extending from the rear top corner to the bottom front corner of the side wall, as shown in FIG. 4. By so doing, mail will not be impeded or catch on the edge of the walls, which edges could otherwise interfere with mail transport into the secure chamber below the cover plate.

Catch plate assembly 12 is best located with rearward forward edge 19 of catch plate 18 vertically aligned below lip 14 of cover plate 8. So positioned, given the ergonomics of the human arm, extension of a hand into the secure chamber is further impeded as an inserted hand encounters the sloped capture surface of the catch plate, forcing the fingers to flex inwardly, away from the bottom of the box.

Yet another embodiment of the invention is shown in FIGS. 8–11, in which a unitary mailbox 58 is illustrated, configured to provide a tamper-resistant receptacle. Here, rather than provide a secure chamber by way of modification to an existing mailbox design, the mailbox of this embodiment is configured to define a compression delivery channel through which mail can be securely deposited. Once clear of the lip of the plate forming the lower surface of the compression delivery channel, inserted objects will fall into the secure chamber, inaccessible except though openable, locked doors. It should be appreciated in terms of security, that the singular box of this embodiment provides greater protection than the afore-described embodiments of FIGS. 1–7. With its deeper chamber, as the unitary box fills with mail, pieces to the top of an accumulated pile are much less likely to become accessible to the reach of an unauthorized individual.

Figure 8:
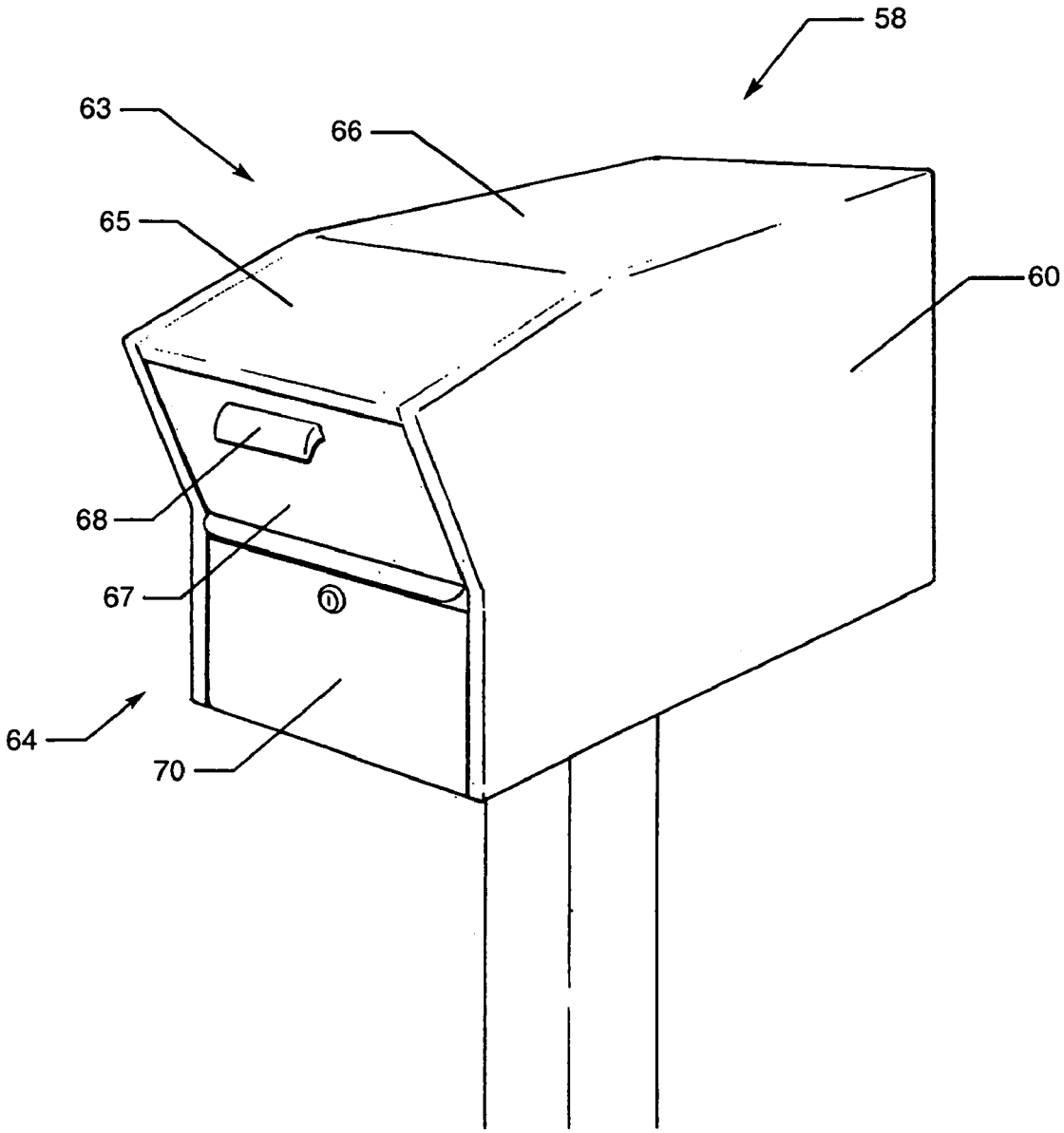
FIG. 8 is a three dimensional depiction of a unitary mailbox showing the mail slot cover and access doors in the closed position.
Figure 10:
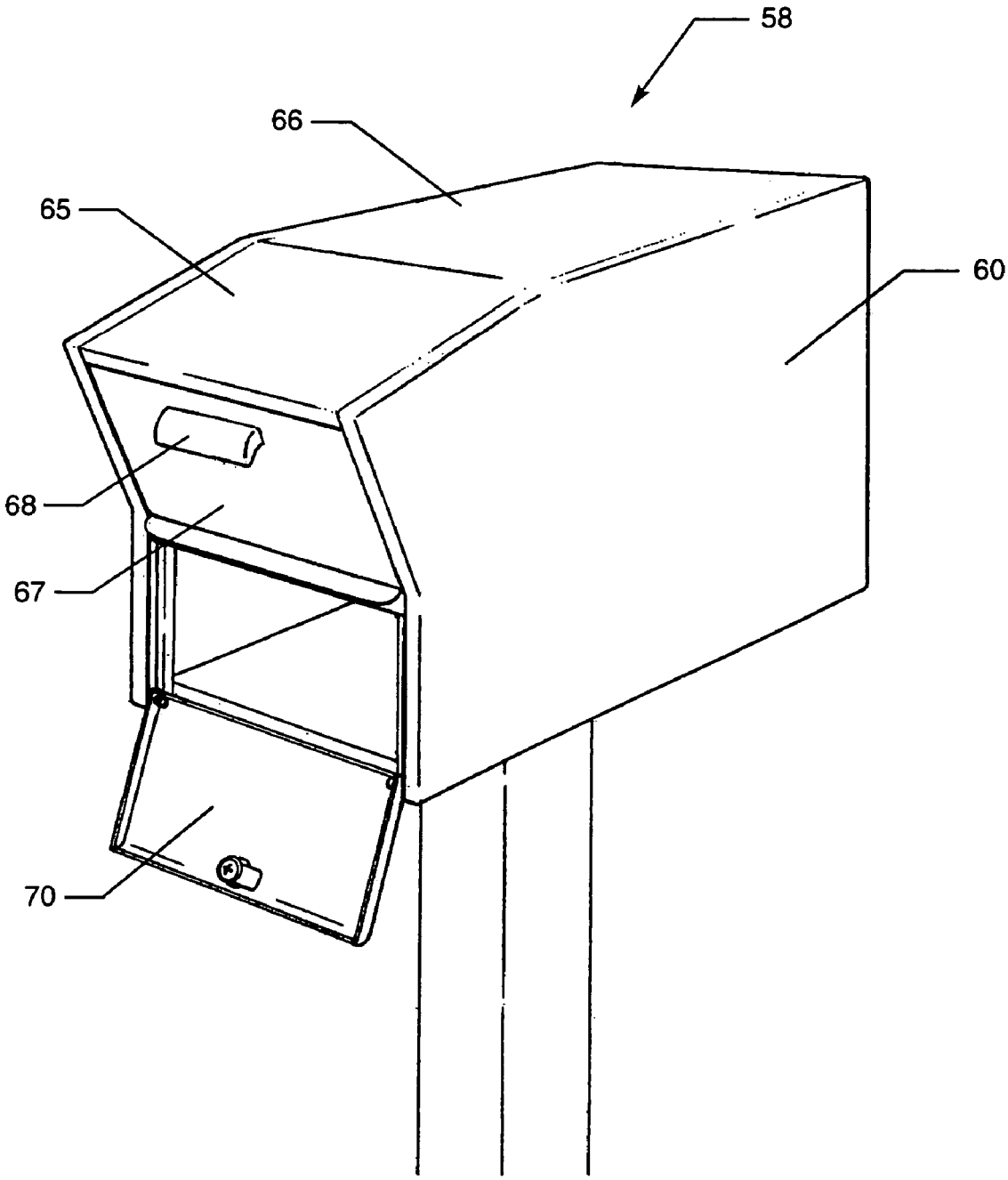
FIG. 10 is a three dimensional depiction of the unitary mailbox of FIGS. 8,9 and 11 with the access door shown in the open position.

With reference to FIG. 8, a mail box of the invention is illustrated shown installed on a supporting post. The mailbox housing is defined by a bottom wall 59 (not shown), opposing side walls 60, rear wall 62 (not shown), top wall 63 and front face 64. The top wall of the box actually consists of a first forward section 65, which for a predetermined distance is sloped upwardly, and a second, rearward section 66 that extends horizontally to the back of the box where it joins rear wall 62. The front face 64 includes a mail slot door 67 which can be gripped by attached handle 68 to open the box and allow the deposit of mail there-within. The mail slot cover will generally be attached to the face of the box by a hinge, though any method of movably mounting mail slot door 67 to allow for opening and closing can be used. Front access door 70 lies below mail slot door 67, and is provided with a locking mechanism, in the figures illustrated as a keyed lock. With reference to FIG. 10, the box is shown with the front access locking door 70 in the open position. Access to deposited mail can be obtained by an intended recipient by unlocking front access door 70. Alternatively, as shown in transparent view FIG. 11, secondary access can be afforded by providing a rear access door 72 in rear wall 62, a similar locking mechanism used to secure the door in place for the receipt of mail.

Figure 9:
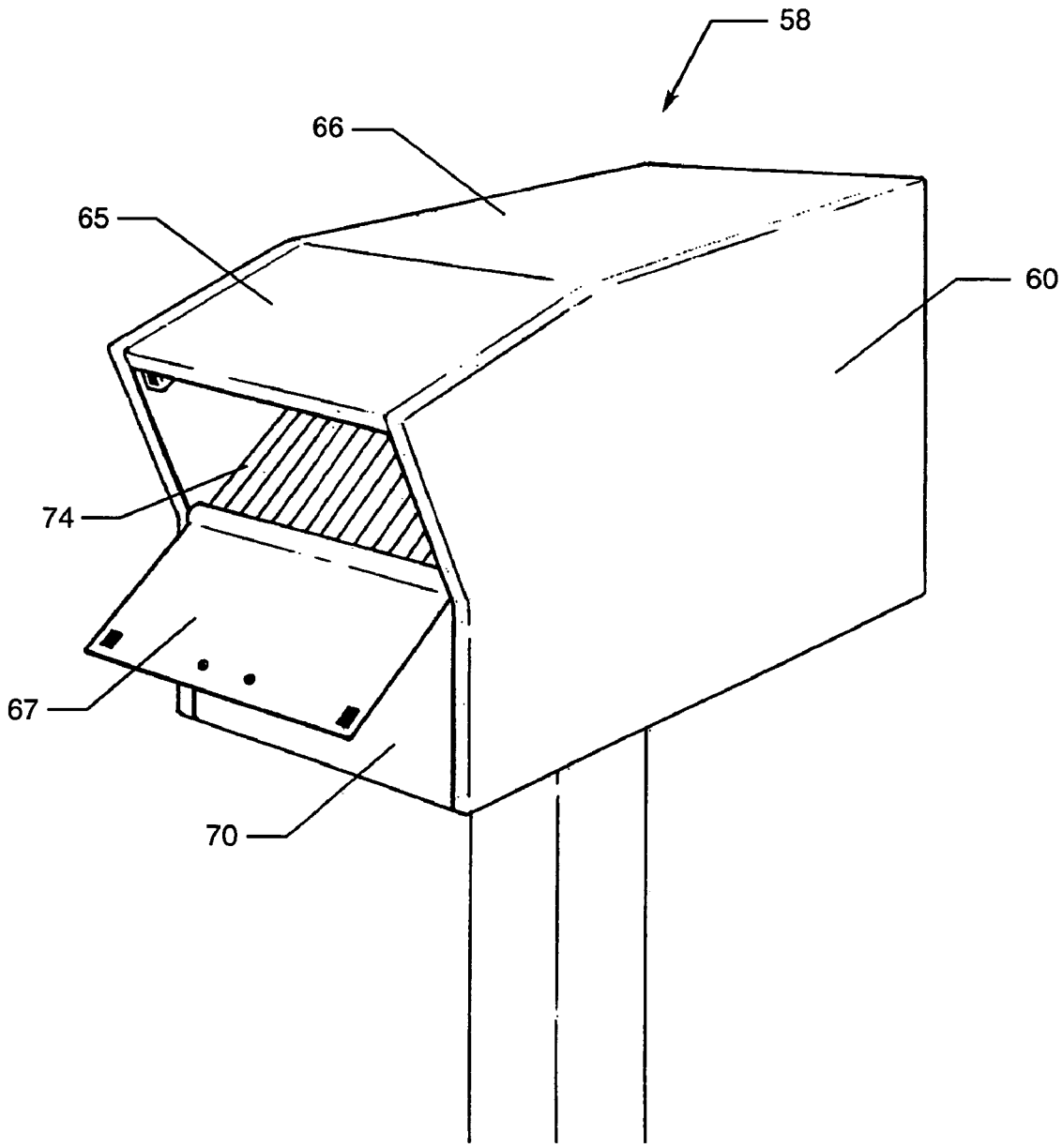
FIG. 9 is a three dimensional depiction of the unitary mailbox of FIG. 8 with the mail slot cover door shown in the open position.

Referring now to FIG. 9, the mail slot door 67 is shown lowered to the open position to expose delivery guide plate 74. This guide plate defines a sloped surface over which mail can be passed. It may be planar, or at its trailing edge may be bent and extended a short distance to the horizontal as illustrated in transparent view FIG. 11. The secure storage chamber 76 receives mail inserted into the box and passed over and beyond the trailing edge 77 of delivery guide plate 74.

Figure 11:
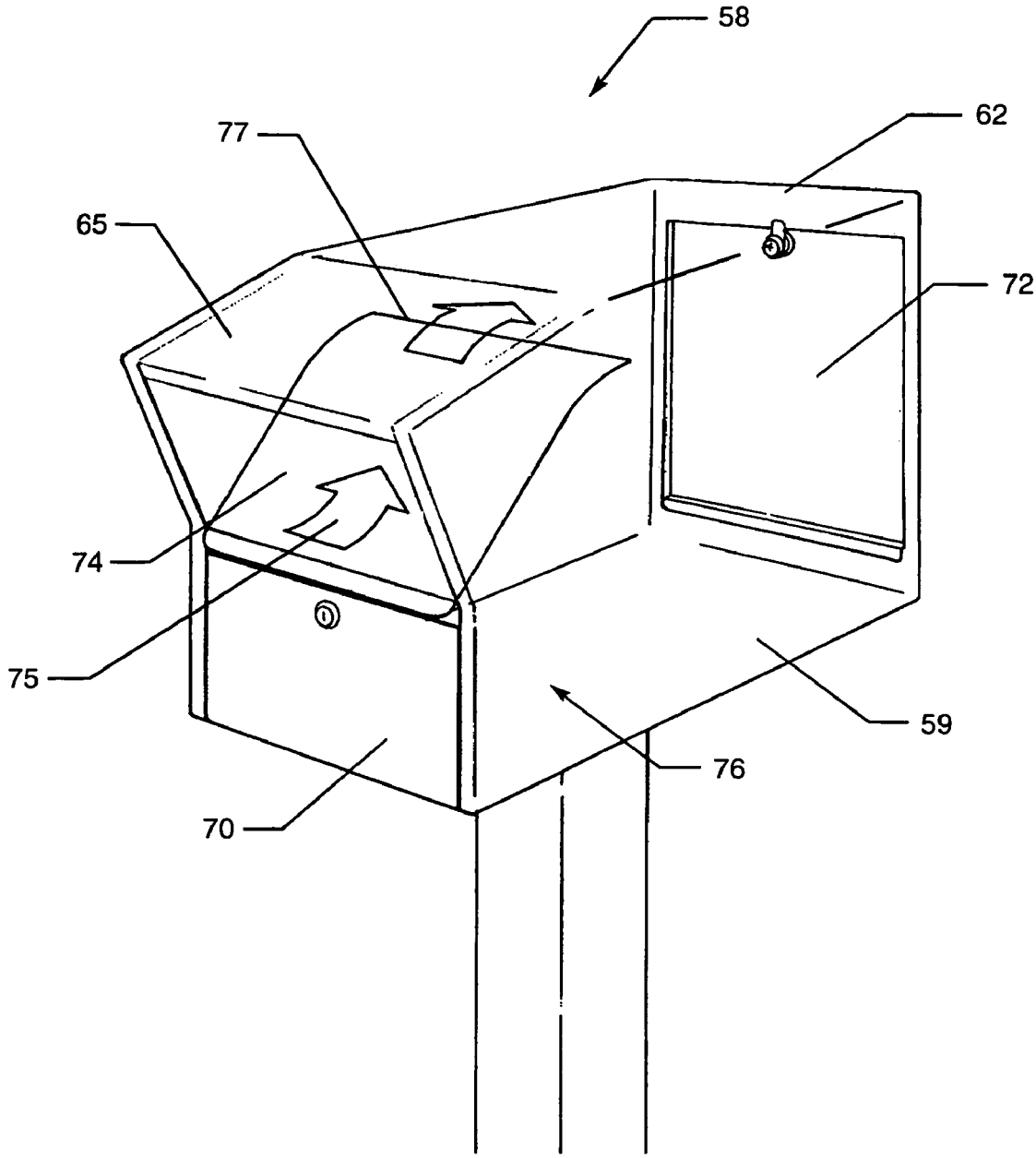
FIG. 11 is a transparent view of the mailbox of FIGS. 8–10 illustrating the internal compression delivery channel.

As shown in FIG. 11, delivery guide plate 74 in combination with front forward section 65, sloped upwardly though at a smaller angle, defines a compression delivery channel 75 for both the delivery of mail and the obstruction of illegal access. Channel 75 has a progressively reduced cross section, the channel extending from the front of the mailbox to at least the leading edge of rearward section 66. A first, vertical opening at the end of channel 75 is bounded by side walls 60, top wall 66 and trailing edge 77 of delivery guide plate 74. It should be small enough to prevent unauthorized access, but large enough to be compliant with Postal regulations which define the size for secure mailbox openings. By way of example, said regulations call for an opening at least 2½ inches by 11 inches.

With the inclined compression delivery channel best shown in FIG. 11, the arm of an unauthorized user is directed upwardly and away from the secure chamber, allowing only for the bending of the hand at the wrist to attempt access to the box interior. To further impede forearm insertion, the delivery guide plate may be provided as a convex continuously curved surface to define an ever compressing delivery channel. Given the geometry of the system, the lack of bendability of the human forearm, and the vertical distance from trailing edge 77 of delivery guide plate 74 to the floor 59 of the mailbox, it is not possible to reach down to access mail residing within storage chamber 76.

During the process of mail delivery, an item of mail is passed up and across the inclined compression channel 75, and inserted through the first opening to a point at least beyond its center of gravity such that the inserted item will fall forward, and drop through a second, horizontally disposed opening bounded by side walls 60, rear wall 62 and trailing edge or lip 77 of delivery guide plate 74, and into the secure storage chamber. Alternatively, mail can be slid upwardly on the delivery guide surface with sufficient force such that inserted mail will pass beyond trailing edge 77 of the compression delivery channel. In this embodiment, rear wall 62 serves as a catch plate to redirect the mail into the secure chamber. Access to the storage chamber for retrieval of said items of mail is effected by an authorized recipient with a key to the locking mechanism associated with the forward or rear access doors.

In an alternative embodiment of the mailbox of FIGS. 8–11, mail slot door 66 can be omitted, such that when a mail carrier delivers mail to the box, all the carrier need do is insert the mail into the open passageway and push it forward a distance sufficient for it to drop into the open chamber. In this embodiment, where the mail slot door has been removed, the mailbox can be provided with a rear flap at the end of the delivery channel to cover the first, vertical opening, to thereby isolate the chamber from the outside environment. Thus, the entry for example of wind driven rain into the secure chamber where delivered mail may reside can be prevented.

In the case of the inserts illustrated in FIGS. 1–7, the dimensions of the inserts are limited in that they must be sized to fit within the confines of an existing mailbox. In the embodiment of FIGS. 8–11, the lack of constraint as to the size of the box allows for the free selection of dimensions, by which the secure chamber can be made much larger than that which is afforded by the embodiments of earlier figures.

It should be appreciated that while the invention has been described with reference to specific embodiments, many fabrication options are available within the scope of the invention. For example, though means are disclosed for securing the inserts of the first embodiment to the sides of a mailbox, i.e., gluing, other attachment means may be employed, the exact securing means not critical to the invention. Furthermore, the materials of construction are not critical. The inserts of the first embodiment and the mailbox of the second can be made of any suitably rigid material, including plastic, steel, or aluminum. What is important is that the gauge of the material be thick enough so as to be stiff and not easily bent. Similarly, the particular dimensions of the various components are not critical so long as they are sized to function cooperatively to define a secure chamber for receiving deposited mail.

As the present invention may be embodied in several forms without departing from the spirit of the essential characteristics thereof, it should also be understood that the above described embodiments are not to be limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A rural mailbox providing for secure receipt of delivered mail, including:

a housing having a top, bottom, sides and front and back walls to generally define a box, a delivery guide plate defining a surface over which mail can be passed, said guide plate disposed in, and spanning said box internally between said side walls, said guide plate having a leading edge and a trailing edge, which plate extends from a front face of said box rearward a predetermined distance into the box, to define an upwardly sloped surface;

a compression passageway for receiving mail defined by an opening bounded between the guide plate and the top and side walls of the box;

a first vertically disposed opening through which mail can pass to reach a secure interior compartment of the mailbox, the opening located at a rear end of the compression passageway, a second, horizontally disposed opening through which mail can drop to the bottom of the mailbox, said opening bounded at its one end by the trailing edge of the guide plate and at its other end by the back wall of the mailbox, said secure compartment defined by the guide plate, and the front, side and bottom walls of the mailbox, said compartment disposed at least in part below the guide plate to receive mail after its has passed through said first opening and dropped through said second opening;

a door to said secure compartment for obtaining access thereto to retrieve mail, once delivered;

a locking mechanism for maintaining closure of said door until unlocked by an authorized user; and wherein the top wall of the box is sloped upwardly toward the back wall of the mailbox for a designated distance such that the compression passageway has a continuously reducing cross section in the direction of mail travel.

2. The mailbox of claim 1 in which the door to the secure compartment is located at the front face of the mailbox.

3. The mailbox of claim 1 in which the door to the secure compartment is incorporated into the back wall of the mailbox.

4. The mailbox of claim 1 where the entry to the compression passageway is covered by an openable door.

5. The mailbox of claim 1 including a rear flap positioned at the rear end of the compression passageway to separate the secure compartment from the outside environment.

* * * * *